US006055903A

United States Patent [19]

Eigenmann

[11] Patent Number: 6,055,903

[45] Date of Patent: May 2, 2000

[54] PRESS, SPECIFICALLY PUNCH PRESS

[75] Inventor: Oskar Eigenmann, Arbon, Switzerland

[73] Assignee: Bruderer AG, Frasnacht, Switzerland

[21] Appl. No.: 09/182,021

[22] Filed: Oct. 29, 1998

[30] Foreign Application Priority Data

Dec. 12, 1997 [EP] European Pat. Off. ..... 97121919

[51] Int. Cl.[7] ..... B30B 1/06

[52] U.S. Cl. ..... 100/257; 72/446; 72/450; 72/452.5; 74/40; 83/530; 83/632; 100/282; 100/285

[58] Field of Search ..... 100/282, 283, 100/285, 286, 257; 72/446, 450, 451, 452.5; 74/40, 38; 83/615, 630, 632, 530, 640

[56] References Cited

U.S. PATENT DOCUMENTS

| | | | |
|---|---|---|---|
| 1,089,558 | 3/1914 | Hinde et al. | 72/450 |
| 2,105,053 | 1/1938 | Patrick | 100/285 |
| 2,120,356 | 6/1938 | Glasner | 72/451 |
| 2,204,413 | 6/1940 | Hubbert | 100/285 |
| 2,410,095 | 10/1946 | McInturff | 74/40 |
| 2,951,379 | 9/1960 | Longfield | 74/40 |
| 4,156,387 | 5/1979 | Portmann | 100/282 |
| 4,276,823 | 7/1981 | Rotzler | 100/282 |
| 5,052,257 | 10/1991 | Eigenmann | 83/530 |
| 5,287,728 | 2/1994 | Yoshida | 74/40 |
| 5,848,568 | 12/1998 | Imanishi | 100/282 |

FOREIGN PATENT DOCUMENTS

| | | |
|---|---|---|
| 0628403 | 12/1994 | European Pat. Off. . |
| 0724953 | 8/1996 | European Pat. Off. . |
| 0648596 | 8/1998 | European Pat. Off. . |
| 543376 | 12/1973 | Switzerland . |
| 546141 | 2/1974 | Switzerland . |
| 574323 | 4/1976 | Switzerland . |
| 1174184 | 12/1969 | United Kingdom . |

*Primary Examiner*—Stephen F. Gerrity
*Attorney, Agent, or Firm*—Ladas & Parry

[57] ABSTRACT

A connecting rod unit is eccentrically supported on the drive shaft. The connecting rod unit is pivotally mounted via link members to double arm levers. Each double arm lever is pivotally mounted to a single arm lever. Furthermore, each single arm lever is coupled at its end remote from the double arm levers to a device for the adjusting of the height position of the ram. Each single arm lever supports a pressing column. These pressing columns are pivotally mounted to the ram. Accordingly, the structural members which transmit the driving force from the connecting rod unit to the pressing columns can be designed extremely stiff and with a minimal springiness. Also, all structural members located between the connecting rod unit and the ram, inclusive the ram, are designed in such a manner that no additional balancing forces for the vertical mass force balancing are needed.

20 Claims, 6 Drawing Sheets

PRESS, SPECIFICALLY PUNCH PRESS

BACKGROUND OF THE INVENTION

1. Field of the Invention

The present invention relates to a press, having at least one pressing column and a ram pivotally mounted to said at least one pressing column, which ram is adapted to be connected to at least one tool for a shape producing working of a strip-shaped workpiece which is advanced step by step, which press includes a machine frame and a drive shaft which is supported in the machine frame and includes at least one connecting rod unit which is supported eccentrically on said drive shaft.

2. Description of the Prior Art

In the corresponding technical field such presses are defined as punch presses and the present invention relates specifically to a so-called high-speed punch press. In these days such presses are designed to have a large rated force and having large spaces for a mounting of tools. The rams are driven from a drive shaft of the punch press via an arrangement of force-transmitting elements which in turn must be of a very rigid design, which must have a high spring rate and accordingly feature large masses.

Conclusively, extremely high masses are moved at extremely high numbers of stroke in such high-speed punch presses, wherewith very high mass forces as well as high acceleration and deceleration forces occur.

In operation of a high speed punch press not only extremely large forces of inertia and moments of inertia are generated by the ram and the force transmitting elements, but also extremely large forces and moments due to imbalances which must be balanced. In order to balance the forces and moments of the imbalance, balancing weight devices, that is balancing masses are needed, which generate in turn additional forces and moments of inertia and produce in their bearings and in the bearings of their drive members frictional forces.

Furthermore, such punch presses are subject to high demands regarding the precision and quality of the products produced thereon.

A great many punch presses have become known which feature excellent structural solutions to the individual problems described above, however, designs which are advantageous for a given problem area lead often to drawbacks in a further, different problem area.

The punch press according to CH-A-543 376 displays for instance a large distance between the pressure columns which has an advantageous effect on the ram regarding its rigidity against tilting. Furthermore, the structural members which transmit the drive force from the drive shaft onto the ram are designed in such a manner, that the masses which oscillate in the vertical direction are balanced to the largest extent. However, there are still balancing weight units necessary for a complete balancing of the masses oscillating in the vertical direction, with the effect that additional forces of inertia and frictions in bearings are produced. Specifically, the design of the members of the machine which transmit the drive force from the drive shaft onto the ram is such that long paths of the transmittal of forces are present, wherewith a larger spring elasticity of the machine is produced which has a detrimental effect onto the punching process. The structural members which are used for adjusting the height position of the ram and are located at the point of reversing of the forces, i.e. the bearing point of the double arm lever of mentioned punch press, are loaded with twice the punching force.

The CA-A 574 323 discloses a punch press in which the parts of the machine which transmit the driving force from the drive shaft onto the ram form no long paths of transmittal of the forces. Due to the distribution of the forces via the single arm levers, the forces acting onto the connecting rod and onto the structural members for the adjusting of the height position of the ram are reduced. The pressure columns feature, however, a small distance from each other, which is a drawback regarding the rigidity of the ram against tilting. Furthermore, large balancing masses are needed which generate correspondingly high forces of inertia, high moments of inertia, and bearing frictions.

SUMMARY OF THE INVENTION

A general object of the present invention is to provide a punch press, specifically a high-speed punch press which displays short paths of transmittal of forces between the drive shaft and the ram and incorporates therewith a small spring elasticity, but allows a large distance between the pressure columns such to counteract advantageously a tilting of the ram, which allows a long space for the mounting of tools without a overly large increase of the masses of the structural members which transmit the drive force onto the ram and which is not in need of vertically acting balancing masses.

A further object is to provide a punch press wherein the connecting rod unit is connected to a respective pressing column via a respective rocking member and a single arm lever pivotally mounted to the rocking member.

The advantages gained by the invention are seen specifically in that the structural members adapted for the transmitting of the drive force from the drive shaft to the ram are designed rigid and hardly springy and form small moving masses also in case of long spaces for the receipt of tools in the punch press. Therewith only small masses of the balancing weights are necessary. Furthermore, in operation of the punch press only small dynamic forces and moments of inertia of masses and a minimum of bearing frictions occur.

BRIEF DESCRIPTION OF THE DRAWINGS

The present invention will be more fully understood and objects other than those set forth above will become apparent when consideration is given to the following detailed description thereof. Such description makes reference to the annexed drawings, wherein.

DETAILED DESCRIPTION OF THE PREFERRED EMBODIMENTS

Figure 1:
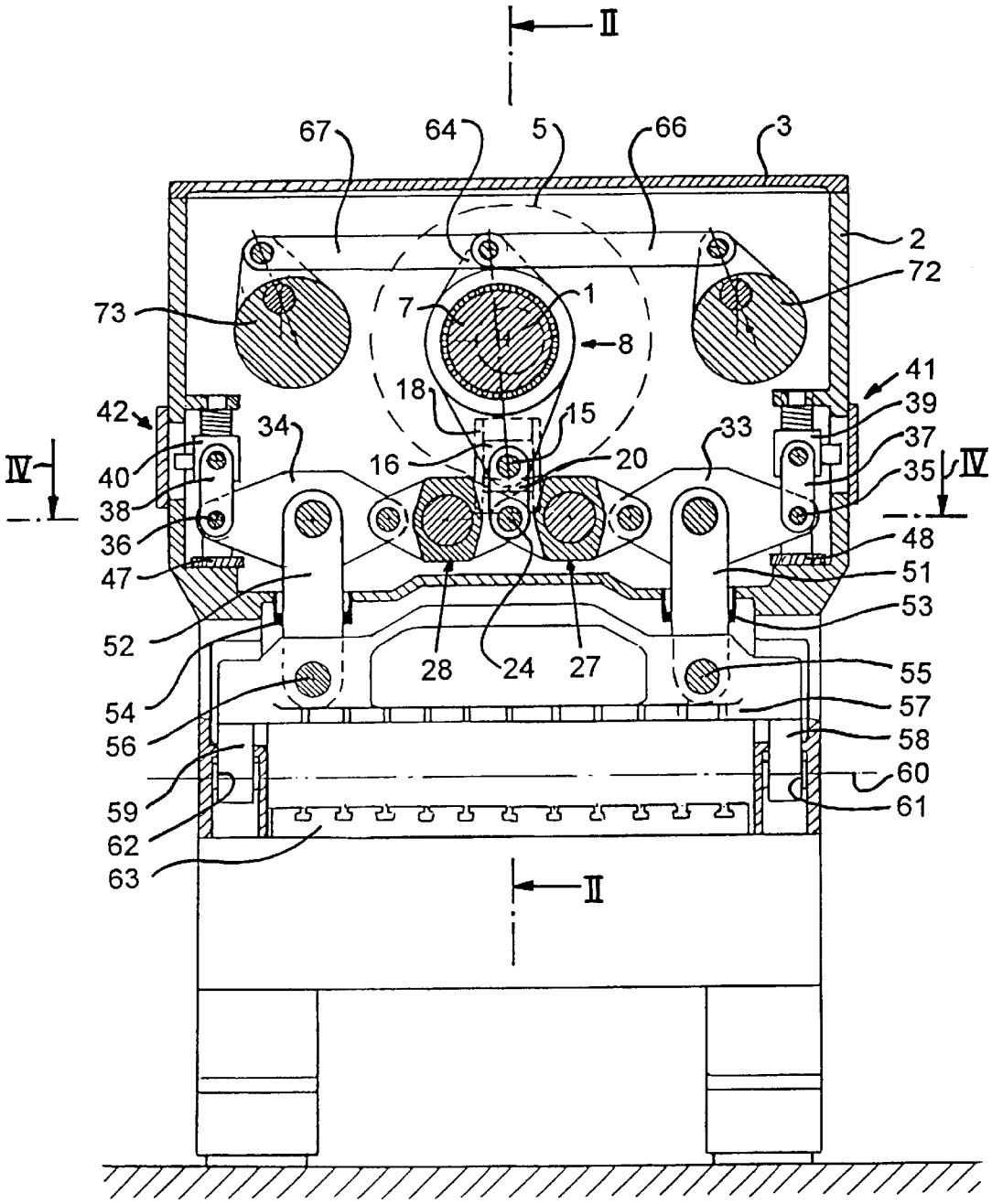
FIG. 1 is a view of a longitudinal section through a punch press.

The drive shaft 1 of the punch press is supported in the machine frame 2 which is closed at the top by a top plate 3.

The driving of the drive shaft 1 proceeds from a (not illustrated) motor and a belt drive of which a belt pulley 4 is illustrated. The driving force is transmitted from the belt pulley 4 via a breaking/coupling device 5 onto the drive shaft 1. Such breaking/coupling devices are generally known, and regarding a detailed description thereof, attention is drawn for instance to CH-A-546 141.

For sake of better understanding the breaking disk 6 of the breaking/coupling device is illustrated in the figures.

The drive shaft 1 includes a eccentric portion 7 on which a connecting rod unit is supported which is identified generally by the reference numeral 8.

Figure 3:
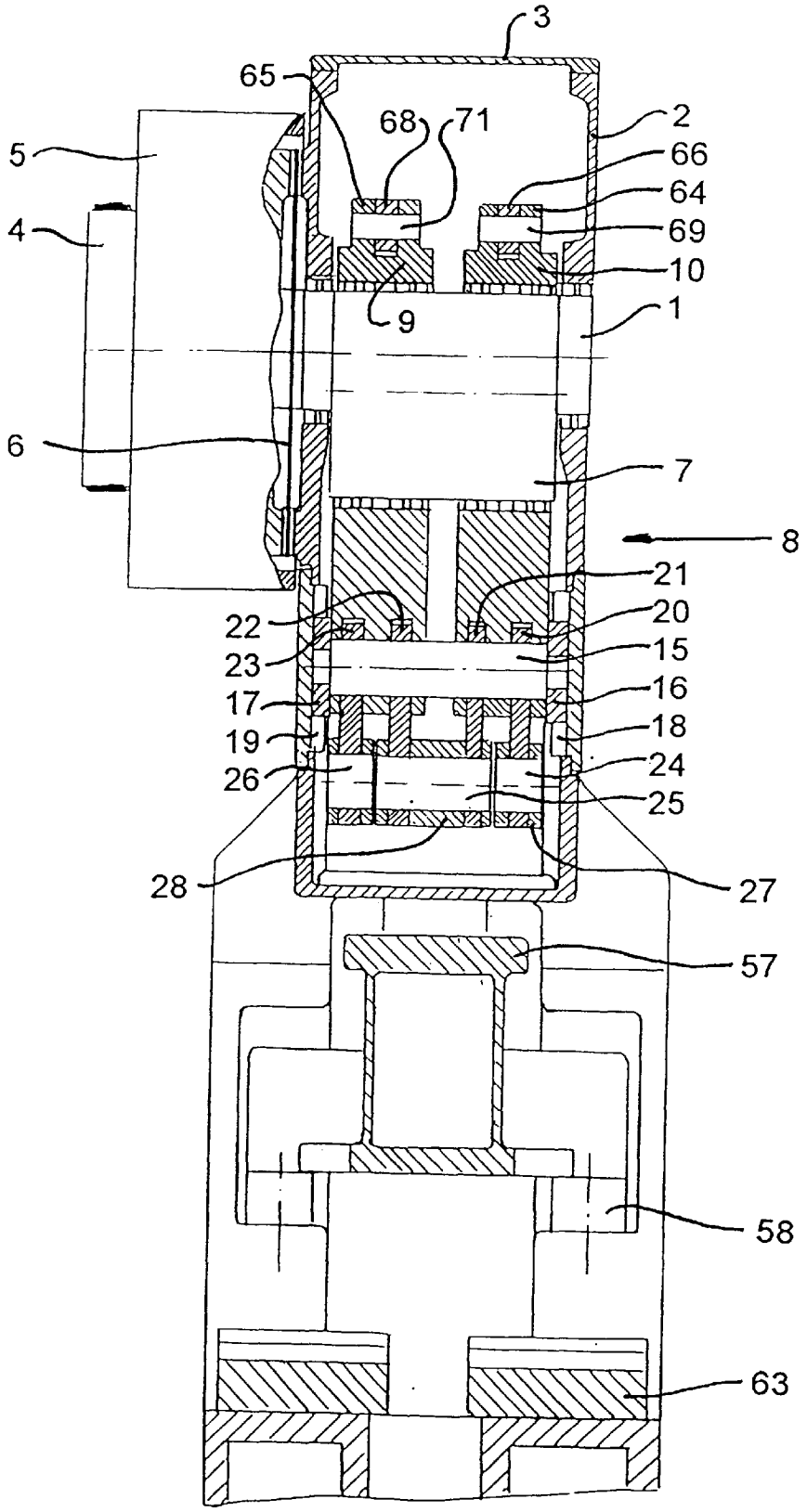
FIG. 3 is a section along line III—III of FIG. 1, illustrated on a larger scale.
Figure 4:
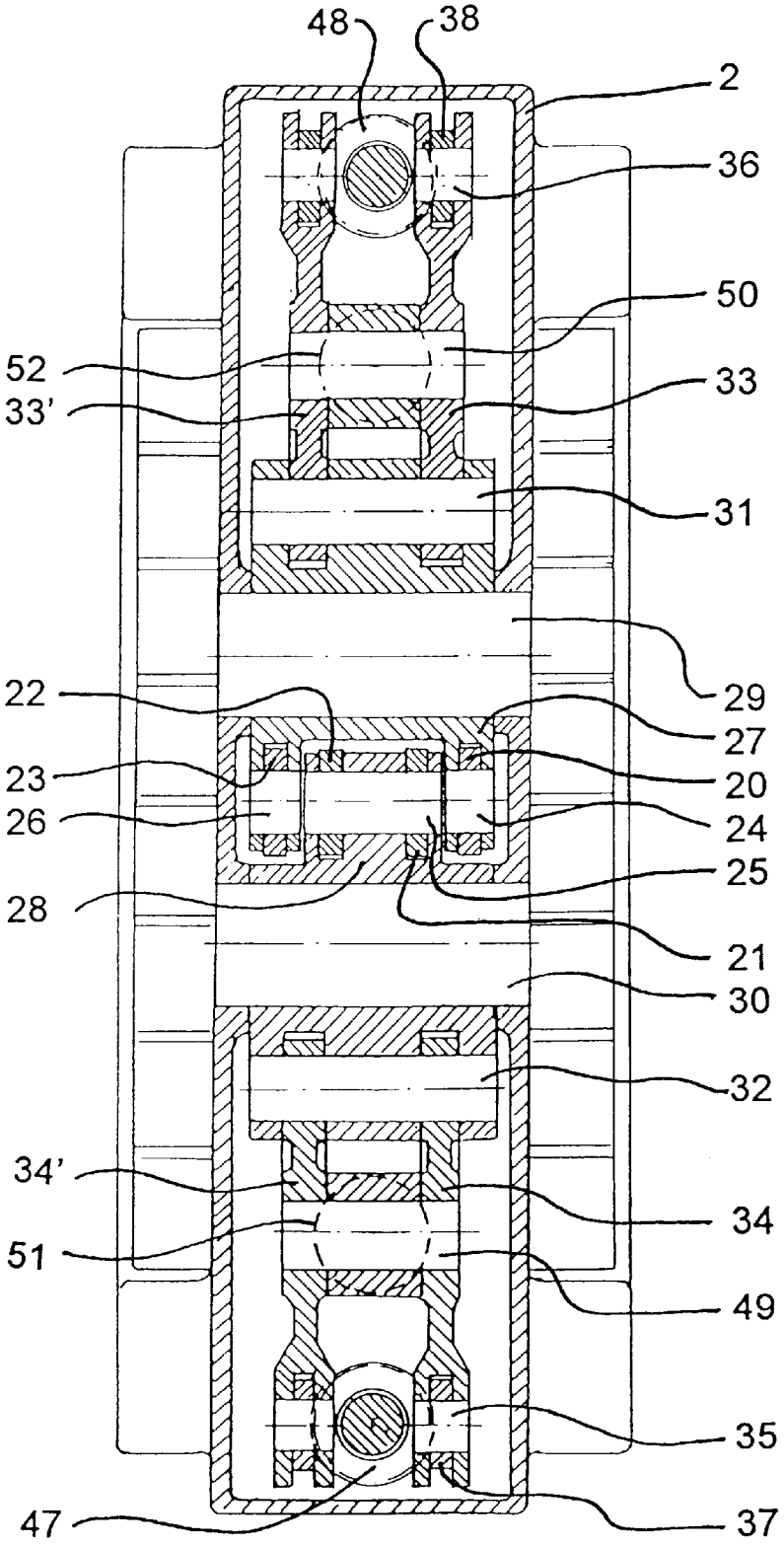
FIG. 4 is a section along line IV—IV of FIG. 1, illustrated on a larger scale.

In the embodiment according to FIGS. 3 and 4 this connecting rod unit 8 includes two connecting rod members 9, 10. In the embodiment according to FIGS. 5 and 6 which will be described in detail further below, the connecting rod unit 8 includes four connecting rod members 11, 12, 13, 14.

In the lower ends of the connecting rod members 9, 10 a connecting rod pin 15 common to both is received. At both its ends this connecting rod pin 15 is connected to a slider member 16, 17. The slider member 16 is guided in a guide 18 and the slider member 17 is guided in a guide 19.

Four link members 20, 21, 22, 23 are pivotally mounted to the connecting rod pin 15. The link members 20, 21 from a first pair of link members of which the upper ends of the link members 20, 21 project into the connecting rod member 10.

The link members 22, 23 form a second pair of link members of which the upper ends of the link members 20, 23 project into the connecting rod member 9.

The link member 20 of the first link member pair 20, 21 is pivotally mounted at its lower end to a first pivot pin member 24. The link member 21 of the first link member pair 20, 21 is pivotally mounted to a second pivot pin member 25. The link member 22 of the second link member pair 22, 23 is also pivotally mounted to the second pivot pin member 25. The link member 23 of the second link member pair 22, 23 is pivotally mounted to a third pivot pin member 26.

The first pivot pin member 24 and the third pivot pin member 26 are inserted into a first double arm lever 27, which is pivotally mounted and connected via link members 20 and 23, which take up the height of its pivotal arc, to the connecting rod members 9 and 10.

The second pivot pin member 25 is inserted into a second double arm lever 28, which is also pivotally mounted and connected via link members 21 and 22, which take up the height of its pivotal arc, to the connecting rod members 9 and 10.

Figure 2:
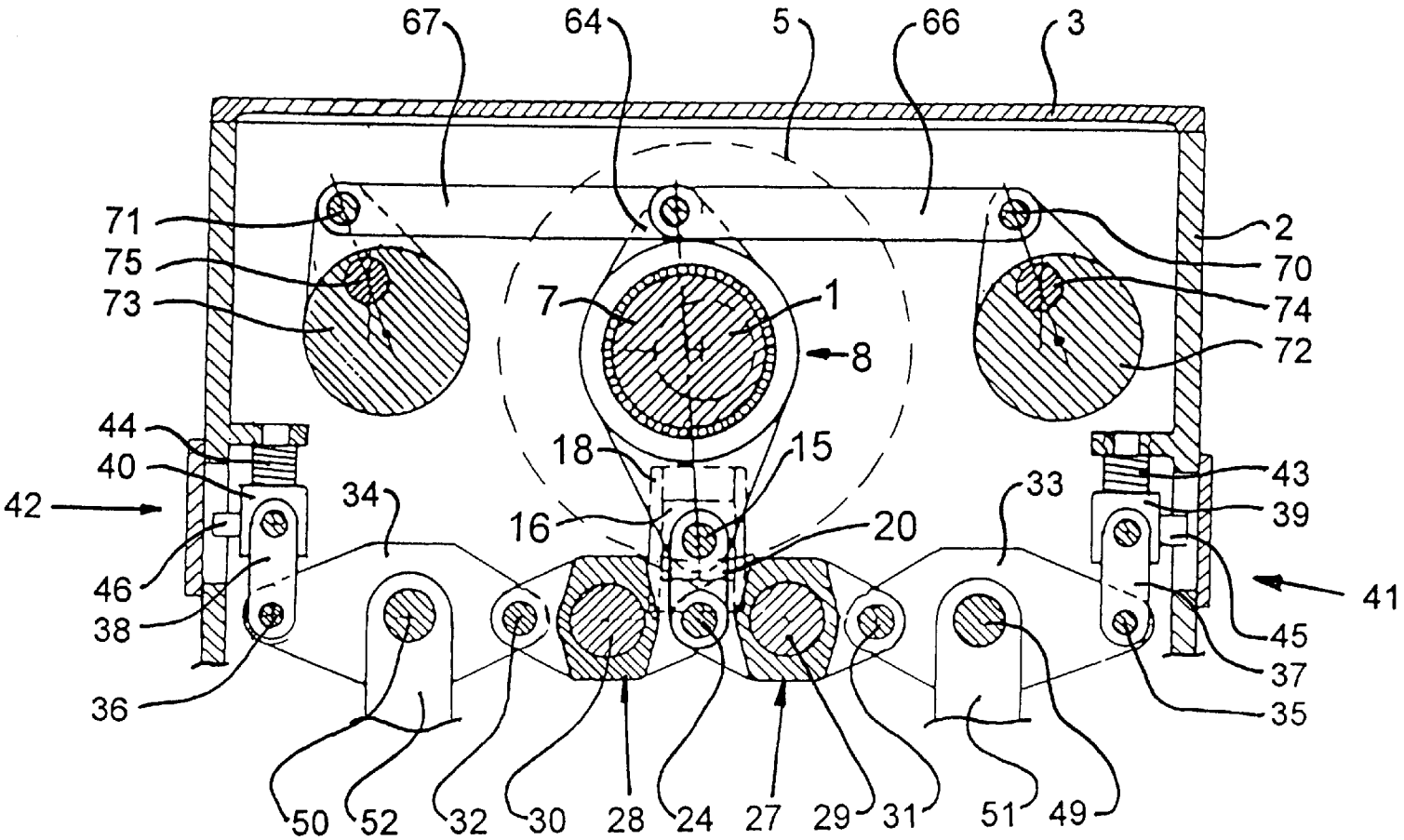
FIG. 2 illustrates a part of FIG. 1 designed on a larger scale.

In the illustrated embodiment the double arm levers 27, 28 which operate as rocker members are of a point symmetrical design. In the illustrated embodiment they comprise lever arms of the same length. However, embodiments with lever arms of an unequal length are foreseen. These double arm levers 27, 28 are supported via bolts 29, 30 in the machine frame 2 (FIG. 2 and FIG. 4).

At their end remote from the link members 20, 21, 22, 23 the double arm levers 27, 28 are pivotally mounted via pivot pins 31, 32 to single arm levers 33, 34. At the other end the single arm levers 33, 34 are pivotally mounted via pivot pins 35, 36 and link members 37, 38 to the spindle nuts 39, 40 of the devices 41, 42 for the adjusting of the height position of the ram 57, of which devices the spindles 43, 44 the pins 45, 46 for the rectilinear guiding of the spindle nuts 39, 40 in the machine frame 10 and the drive gear wheels 47, 48 for the rotating of the spindles 43, 44 are illustrated. In FIG. 4 the single arm levers are provided in addition to the reference numerals 33, 34 also with the reference numerals 33', 34'. The reason thereto is that each of these levers include due to structural reasons two single arms located side by side, namely 33, 33' and 34, 34'.

A detailed description of these devices for adjusting the height position of the ram is disclosed in the U.S. patent application 5,052,257. A pressing column 51, 52 is pivotally mounted to each single arm lever 33, 34 via a pivot pin 49, 50, which pressing columns 51, 52 extend through moveable seals 53, 54 and are pivotally mounted to the ram 57 via bolts 55, 56.

It is to be noted that in the illustrated embodiment the distance between the pivot pins 49, 50 which support the pressing columns 51, 52 and the pivot pins 35, 36 at the devices for the adjusting of the height position of the ram is larger than the distance between the pivot pins 49, 50 supporting the pressing columns 51, 52 and the pivot pins 31, 32 at the double arm levers 27, 28. These relative distances are not mandatory. Other embodiments may display other relations of the distances.

Guiding columns 58, 59 project downwards from the ram 52 which guiding columns 58, 59 are guided in the plane 60 of advance of the strip to be worked upon in column guides 61, 62. In punch presses the plane 60 of the advance of the strip is defined as that plane which is defined by the stepwise fed metal strip which is being processed or which is to be processed in the punch press. The tool carrier plate 63 which is mounted to the machine frame 2 is located below the ram 57.

The connecting rod members 9, 10 of the connecting rod unit 8 feature at the top projecting extensions 64, 65. Lateral bars 66, 67 are pivotally mounted to these projecting extensions 64, 65 which bars extend in opposite directions from the projecting extensions 64, 65. The reference numerals 68, 69 designate the pivot pins. At their end remote from the projecting extensions 64, 65 these lateral bars 66, 67 are coupled via pivot pins 70, 71 to eccentrically supported balancing weight bodies 72, 73. The locations of the support of these balancing weight bodies 72, 73 are identified by the reference numerals 74, 75.

The object of these balancing weight bodies 72, 73 is to balance the horizontal components of the rotating unbalanced mass of the punch press.

The dimensions, the length of the lever arms and the masses of all structural members for the driving of the ram 57 and also the ram 57 itself are dimensioned in such a manner, that no resulting unbalance appears in the vertical direction, i.e. no additional balancing masses for a balancing of any vertical components of unbalance are necessary.

When considering the path of the transmission of force from the connecting rod unit 8 to the ram 57 and the design of the corresponding structural members of the punch press the following can be seen.

The pressing columns 51, 52 are located at an extremely large distance from each other. Conclusively, they are pivotally mounted to the ram 57 at the outermost possible points, such that at an offcenter punch loading of the ram 57 the resistance against a tilting is ensured.

The path of the transmittal of forces from the connecting rod unit 8 to the ram 57 is extremely short. Accordingly, a minimal springiness when subject to a loading due to the punching work of the structural members taking part at the transmittal of force is ensured, which members are correspondingly quite stiff structural members. Furthermore, these structural members are designed in such a manner that they display totally a small mass. Accordingly, the acceleration and deceleration forces are small and, moreover, the loading of the bearings and accordingly the frictions in the bearings can be held at low values. Conclusively, the driving force of the punch press can be held at a low value.

Also, the play in the bearings is smaller and it is possible to produce articles at a higher precision.

The connecting rod unit 8 illustrated in FIG. 1 moves seen in the vertical direction, obviously between an uppermost position (upper dead point position) and a lowermost position (bottom dead point position) and moves through a middle position which is at the same distance from the uppermost and lowermost position.

In this middle position the geometrical axes of the pivotal points of the structural members for the transmission of the drive force define a geometrical straight line. This means, see FIG. 2, that the longitudinal center axes of the bolts and pins, respectively, 24, 30, 32, 50, 36 on the one hand, and 24, 29, 39, 49, 35 on the other hand are located at one common straight line. This leads to the advantage, that the deflections of the levers 28, 34 and 27, 33, respectively are limited to a minimum when the punch press is in operation.

The above described embodiment of the punch press of the present invention illustrated in FIGS. 3 and 4 specifically a singleshaft-twopoint-punchpress, i.e. a punch press which has two pressing columns 51, 52.

Figure 5:
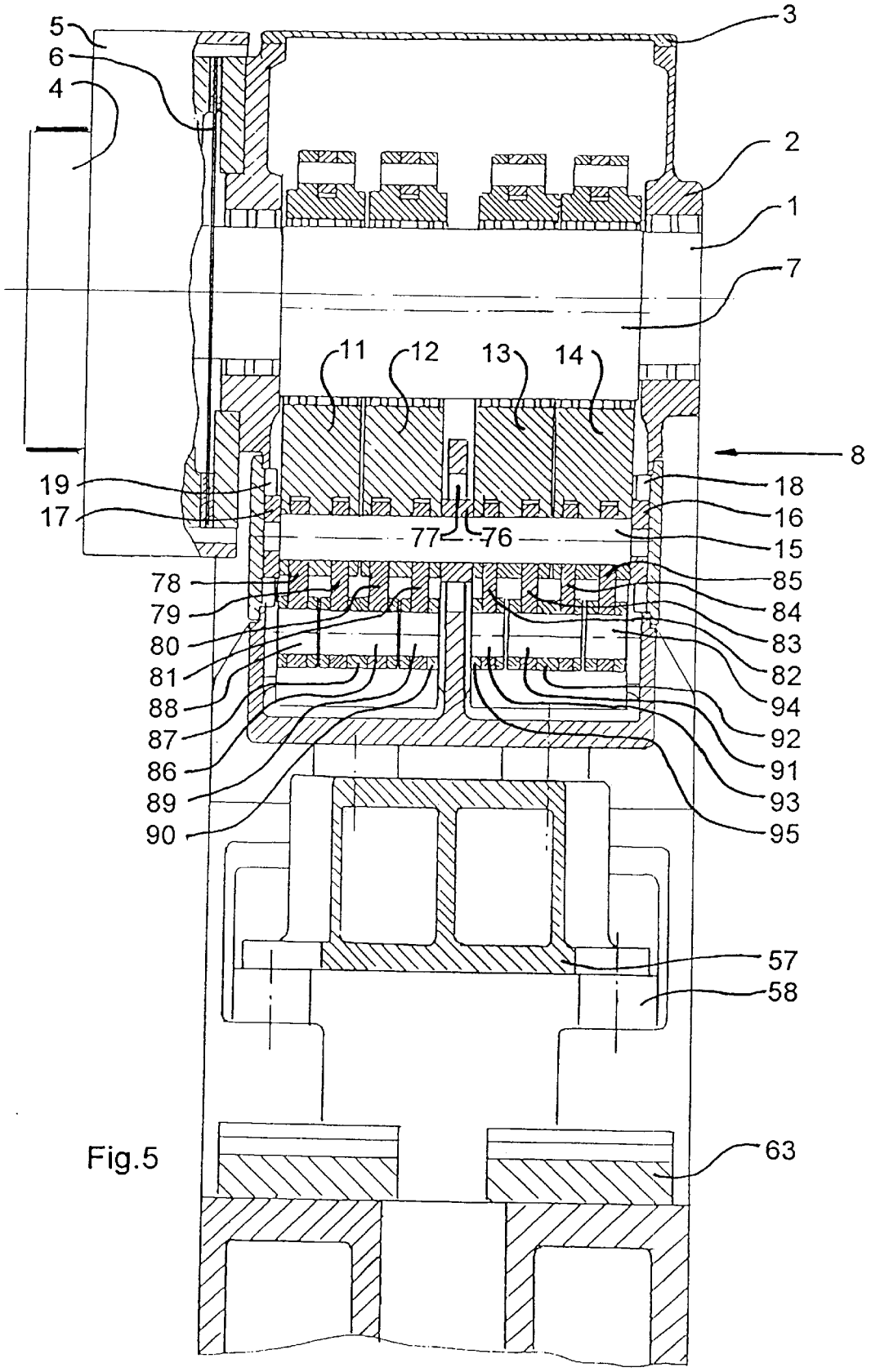
FIG. 5 is a section similar to the section according to FIG. 3 illustrating a further embodiment of the subject of the invention.
Figure 6:
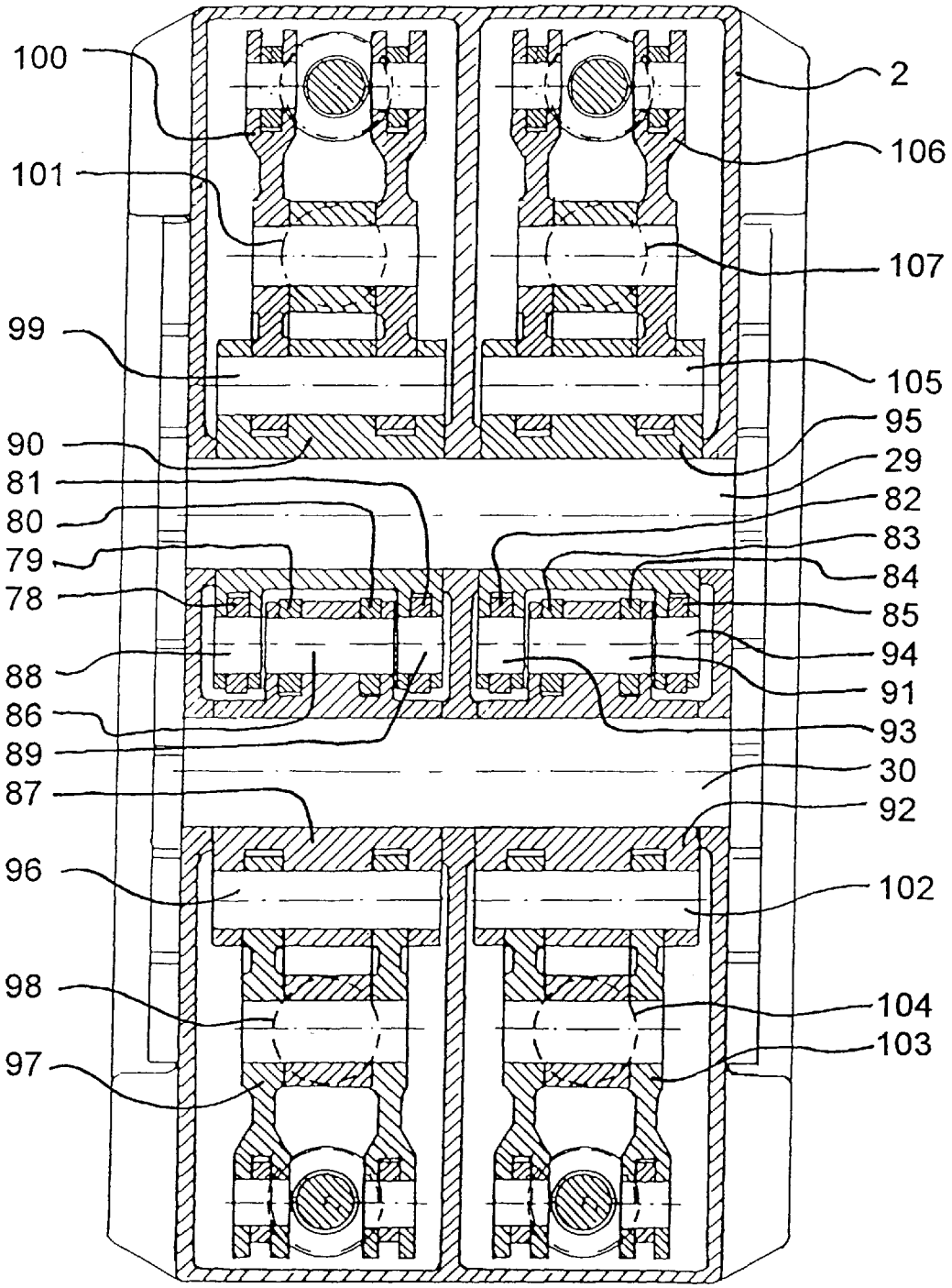
FIG. 6 is a section similar to the section according to FIG. 4 of the embodiment of the subject of the invention according to FIG. 5.

The invention can, however, be embodied, e.g. also at a singleshaft-fourpoint-punchpress which embodiment will now be described with reference to FIGS. 5 and 6.

For sake of clarity the same reference numerals which have been used for the above description are used in the following description as far as possible.

The illustrated punch press includes a drive shaft which is supported in the machine frame 2, whereby the top plate is identified by the reference numeral 3.

The drive proceeds from a not illustrated motor, via a belt drive of which a belt pulley 4 is illustrated. The reference numeral 5 designates the coupling/breaking device of which the breaking disk 6 can be seen.

The connecting rod unit 8 which is supported on the eccentric portion 7 of the drive shaft 1 includes four connecting rod members 11, 12, 13, 14 located side by side. The connecting rod members 11, 12, 13, 14 are coupled to a connecting rod pin 15 common to all.

At its outermost ends the connecting rod pin 15 projects into respective slider members 16 and 17, respectively, and a further slider member 76 is located at its center area. The slider members 16, 17 are guided in guides 18, 19 and the further slider member 76 is guided in the guide 77.

Eight link members 78, 79, 80, 81, 82, 83, 84, 85 are supported on the connecting rod pin 15.

The four link members 78, 79, 80, 81 which are pivotally mounted via the connecting rod pin 15 to the two connecting rod members 11, 12 form a first link member group, and the four link members 82, 83, 84, 85 which are pivotally mounted via the connecting rod pin 15 to the two connecting rod members 13, 15 form a second link member group.

The two inner link members 79, 80 of the first link member group 78, 79, 80, 81 which are located directly side by side are pivotally mounted via a pivot pin member 86 common to both to a first double arm lever 87.

The two outer link members 78, 81 of the first link member group 78, 79, 80, 81 are pivotally mounted via a respective separate pivot pin member 88 and 89, respectively, to a second double arm lever 90.

The inner two link members 83, 84 of the second link member group 82, 83, 84, 85 which are located directly side by side are pivotally mounted via a further pivot pin member 91 common to both to a third double arm lever 92.

The outer two link members 82, 85 of the second link member group 82, 83, 84, 85 are pivotally mounted via a respective further separate pivot pin member 93 and 94, respectively to a fourth double arm lever 95.

The first double arm lever 87 and the third double arm lever 92 located aside of the lever 87 are supported on a bolt 30 common to both.

In the same manner the second double arm lever 90 and the fourth lever 95 located aside of lever 90 are supported on a bolt 29 common to both.

The first double arm lever 87 is pivotally mounted via a pivot pin 96 to a first single arm lever 97 to which a first pressure column 98 is pivotally mounted. The second double arm lever 90 is pivotally mounted via a pivot pin 99 to a second double arm lever 100 to which the second pressure column 101 is pivotally mounted. The third double arm lever 92 is pivotally mounted via a pivot pin 102 to a third single arm lever 103 to which a third pressing column is pivotally mounted. The fourth double arm lever 95 is pivotally mounted via a pivot pin 105 to a fourth single arm lever 106 to which a fourth pressing column 107 is pivotally mounted.

The four pressing columns 98, 101, 104, 107 are pivotally mounted together to the ram 57 such that a four point support of the ram 57 is present.

The other structural units of this second embodiment, e.g. mass balancing weights and their drive, adjustment of the height position of the ram, guide of the ram, etc. are of the same design as the corresponding structures of the first embodiment such that a repeated description thereof is not needed. It merely is to be noted that in the second embodiment various structural members are present twice in comparison with the first embodiment. The longitudinal section of the second embodiment equals the longitudinal section of the first embodiment according to FIG. 1.

While there are shown and described presently preferred embodiments of the invention, it is to be distinctly understood that the invention is not limited thereto but may be otherwise variously embodied and practiced within the scope of the following claims.

I claim:

1. A press, having at least one pressing column and a ram pivotally mounted to said at least one pressing column, which ram is adapted to be connected to at least one tool for a shape producing working of a strip-shaped workpiece which is intermittently advanced, which press includes a machine frame and a drive shaft which is supported in the machine frame, and includes at least one connecting rod unit which is supported eccentrically on said drive shaft;

wherein said connecting rod unit is connected to a respective pressing column directly via a respective rocking member followed by a single arm lever pivotally mounted to the rocking member.

2. The press of claim 1, wherein said rocking member is of a point symmetrical design and is supported at its point of symmetry.

3. The press of claim 1, wherein said rocking member is designed as a double arm lever.

4. The press of claim 3, in which the double arm lever which forms the rocking member is supported in the machine frame for rotation about a stationary axis, is pivotally mounted at one end to said connecting rod unit, and at the opposite end directly to said single arm lever, which single arm lever is pivotally mounted at its end remote from the double arm lever to a device for adjusting the height position of the ram, which device is mounted to the machine frame.

5. The press of claim 3, wherein the double arm lever, in order to compensate for a height of its arc, is pivotally mounted to the connecting rod unit via link members, and that in one operational position of the press pivot axes and axes of rotation of points where the single arm lever is connected to devices for adjusting of a height position of the ram, where the pressing column is pivotally mounted to the single arm lever, where the single arm lever is pivotally mounted to the double arm lever, where the double arm lever is pivotally supported, and where the double arm lever is pivotally mounted to the link members connecting the double arm lever to the connecting rod unit are connected on a straight line common to all.

6. The punch press of claim 3 wherein the connecting rod unit includes projecting extensions which are located relative to the drive shaft opposite of the point where the connecting rod unit is pivotally mounted to the link members via which the connecting rod unit is connected to the double arm levers, further wherein lateral bars extend from the projecting extensions in opposite directions and are pivotally mounted at their ends remote from the projecting extensions each to an eccentrically supported mass balancing weight body, which mass balancing weight bodies are adapted to balance the horizontal components of the rotating unbalanced mass of the press.

7. Press according to claim 3, wherein the connecting rod unit comprises at least two connecting rod members, which connecting rod members are connected via link members for accommodating heights of arc to at least two double arm levers which extend in opposite directions away from each other and in which a connecting rod pin is received at the end remote from the drive shaft, which connecting rod pin is connected to slider members for a rectilinear guiding of the connecting rod members, on which connecting rod pin the link members are arranged in pairs in such a manner that the link members of each pair project at their first end into a respective connecting rod member.

8. Press according to claim 7, characterized in that the one link member of each pair of link members is pivotally mounted to one of the double arm levers via a pivot pin member and the other link member is pivotally mounted via a further pivot pin member to a further double arm lever extending in the opposite direction of the first named double arm lever.

9. Press according to claim 8, wherein the connecting rod unit comprises two connecting rod members arranged side by side and accordingly a group of four link members arranged side by side, of which the inner two link members which are located directly side by side are pivotally mounted via a pivot pin member common to both to one of the double arm levers, and the outer two link members of the group which are located remote from each others are pivotally mounted by a respective separate pivot pin member to the further double arm lever which projects in the opposite direction of the first named lever.

10. Press according to claim 8, wherein the connecting rod unit comprises four connecting rod members located side by side and accordingly eight link members located side by side which are divided in two groups of four link members located side by side; further wherein the inner two link members of the one group of which one located directly side by side are pivotally mounted via a pivot pin member common to both to a first double arm lever and the outer two link members of this one group located remote from each other are pivotally mounted each via a respective separate pivot pin member to a second double arm lever extending in an opposite direction relative to the first double arm lever; further wherein the inner two link members of the other link member group which are located directly side by side are pivotally mounted via a further pivot pin member to a third double arm lever which extends in the same direction as the first double arm lever; and wherein the outer two link members of the other link member group which are located remote from each other are pivotally mounted each via a respective pivot pin member to a fourth lever extending in an opposite direction relative to a third lever, which four double arm levers are pivotally mounted each to a single arm lever which is mounted to a pressing column so that the ram of the press is suspended on four pressing columns.

11. The press of claim 1, wherein the dimensions, masses and lengths of the lever arms of the structural members which move when the press is in operation are selected such, that when the press is in operation the vertical component of the moving masses is zero, so that no structures for a vertical balancing of masses are needed.

12. In a press having a ram for connection to at least one tool and shaping a workpiece when reciprocated, at least one pressing column pivotally connected to the ram, at least one connecting rod unit, a drive shaft for moving the connecting rod unit, and a frame for supporting the drive shaft, the improvements comprising:

a single arm lever pivotally connected to the pressing column for reciprocating the pressing column and, thereby, the ram when reciprocated; and a rocking member pivotally connected at one end to the connecting rod unit for rocking the one end of the rocking member in an arc when the drive shaft moves the connecting rod unit and pivotally connected at an opposite end to the single arm lever for reciprocating the single arm lever.

13. The press according to claim 12, wherein the rocking member is pivoted on the frame at a point between the one and opposite ends of the rocking member.

14. The press according to claim 13, wherein the point is midway between the one and opposite ends of the rocking member.

15. The press according to claim 14, wherein the opposite end of the rocking member is pivotally connected to one side of the single arm lever and an opposite side of the single arm lever is pivotally supported from the frame.

16. The press according to claim 15, wherein the pressing column is pivotally connected to the single arm lever between the one and opposite sides of the single arm lever.

17. The press according to claim 13, wherein the opposite end of the rocking member is pivotally connected to one side of the single arm lever and an opposite side of the single arm lever is pivotally supported from the frame.

18. The press according to claim 17, wherein the pressing column is pivotally connected to the single arm lever between the one and opposite sides of the single arm lever.

19. The press according to claim 12, wherein the opposite end of the rocking member is pivotally connected to one side of the single arm lever and an opposite side of the single arm lever is pivotally supported from the frame.

20. The press according to claim 19, wherein the pressing column is pivotally connected to the single arm lever between the one and opposite sides of the single arm lever.

* * * * *